US007997259B2

(12) United States Patent
Wilson

(10) Patent No.: US 7,997,259 B2
(45) Date of Patent: Aug. 16, 2011

(54) COMPOUND ARCHERY BOW

(75) Inventor: Dennis Anthony Wilson, Kathleen, GA (US)

(73) Assignee: Rex Darlington, Hale, MI (US)

( * ) Notice: Subject to any disclaimer, the term of this patent is extended or adjusted under 35 U.S.C. 154(b) by 437 days.

(21) Appl. No.: 12/290,750

(22) Filed: Nov. 3, 2008

(65) Prior Publication Data

US 2010/0051005 A1 Mar. 4, 2010

Related U.S. Application Data

(60) Provisional application No. 61/014,834, filed on Dec. 19, 2007.

(51) Int. Cl.
*F41B 5/10* (2006.01)

(52) U.S. Cl. ..... 124/25.6

(58) Field of Classification Search ..... 124/25.6, 124/900

See application file for complete search history.

(56) References Cited

U.S. PATENT DOCUMENTS

| | | | |
|---|---|---|---|
| 3,990,970 | A | 11/1976 | Ketchum |
| 4,401,097 | A | 8/1983 | Simonds |
| 4,438,753 | A | 3/1984 | Simonds |
| 4,519,374 | A | 5/1985 | Miller |
| 4,774,927 | A | 10/1988 | Larson |
| 4,838,236 | A | 6/1989 | Kudlacek |
| 4,926,832 | A | 5/1990 | Darlington |
| 4,926,833 | A | 5/1990 | Darlington |
| 4,967,721 | A | 11/1990 | Larson |

(Continued)

FOREIGN PATENT DOCUMENTS

| | | |
|---|---|---|
| CA | 2183305 | 2/1997 |

OTHER PUBLICATIONS

Mulloney, "One Step Beyond the Compound?" Archery World, Sep. 1976.

(Continued)

*Primary Examiner* — John Ricci
(74) *Attorney, Agent, or Firm* — Reising Ethington P.C.

(57) ABSTRACT

A compound archery bow includes a handle having projecting limbs, and first and second pulleys mounted on the limbs for rotation around respective axes. At least a first of the pulleys includes a flat base with a bowstring let-out groove on the base and a bowstring anchor adjacent to the bowstring let-out groove. A draw module is disposed on the base, a cable groove extends along the draw module, and first and second cable anchors are disposed on the base adjacent to respective ends of the cable groove. The cable groove on the draw module is continuous in a plane perpendicular to the axis of the first pulley. A bow cable arrangement includes a bowstring cable extending from the bowstring anchor on the first pulley around the bowstring let-out groove and then toward the second pulley. A first cable extends from the first anchor on the first pulley through a portion of the cable groove on the module and then toward the second pulley. A second cable extends from the second anchor toward the second pulley. Draw of the bowstring cable away from the bow handle lets out bowstring cable from the bowstring cable groove on the first pulley and rotates the first pulley around its axis, lets out the first cable from the groove on the module and takes up the second cable into the groove on the module including a portion of such groove previously occupied by the first cable.

14 Claims, 12 Drawing Sheets

U.S. PATENT DOCUMENTS

| | | | | |
|---|---|---|---|---|
| 4,976,250 | A | 12/1990 | Jeffrey | |
| 4,986,250 | A | 1/1991 | Darlington | |
| 5,092,309 | A | 3/1992 | Beaton | |
| 5,301,651 | A | 4/1994 | LaBorde et al. | |
| 5,368,006 | A | 11/1994 | McPherson | |
| 5,433,792 | A | 7/1995 | Darlington | |
| 5,505,185 | A | 4/1996 | Miller | |
| 5,649,522 | A | 7/1997 | Troncoso | |
| 5,678,529 | A | 10/1997 | Larson | |
| 5,782,229 | A | 7/1998 | Evans et al. | |
| 5,791,322 | A | 8/1998 | McPherson | |
| 5,934,265 | A | 8/1999 | Darlington | |
| 5,975,067 | A | 11/1999 | Strother | |
| 6,082,347 | A | 7/2000 | Darlington | |
| 6,112,732 | A | 9/2000 | Larson | |
| RE37,544 | E | 2/2002 | Darlington | |
| 6,446,619 | B1 * | 9/2002 | McPherson | 124/25.6 |
| 6,516,790 | B1 | 2/2003 | Darlington | |
| 6,666,202 | B1 | 12/2003 | Darlington | |
| 6,688,295 | B1 | 2/2004 | Miller | |
| 6,990,970 | B1 | 1/2006 | Darlington | |
| 2009/0188482 | A1 | 7/2009 | Strother | |
| 2009/0255520 | A1 | 10/2009 | Strother | |
| 2009/0288650 | A1 | 11/2009 | Batdorf | |

OTHER PUBLICATIONS

"Graham Take-Down Dynabo," Archery World, Jun./Jul. 1980.
Patent application of Larry D. Miller for "Archery Bow Assembly," date and serial No. unknown.
Alpine Archery Bow Manual, 1989.
"Instruction Manual—York Thunderbolt DynaBo," York Archery.
"M-10 Dynabo Draw Chart," Martin Archery, Inc.
M-10 Cheetah DynaBo Owner's Manual, Martin Archery.
Bow Cam Drawings received in 2008 and apparently filed in the USPTO in 2005.

* cited by examiner

COMPOUND ARCHERY BOW

This application claims priority from application Ser. No. 61/014,834 filed Dec. 19, 2007.

The present disclosure is directed to compound archery bows having pulleys at the ends of the bow limbs to control the force/draw characteristics of the bow, and more particularly to both single-cam bows having a power let-off cam mounted on the end of one of the bow limbs and dual-cam bows having power let-off cams mounted on the ends of both bow limbs.

BACKGROUND AND SUMMARY OF THE DISCLOSURE

Single-cam and dual-cam compound archery bows have a power cam mounted on one or both ends of the bow limbs to control the draw force on the bowstring and the bending of the limbs as the bowstring is drawn. In single-cam bows, there is a power cam on the end of one bow limb, and a wheel on the end of the other bow limb to facilitate control or time take-up of a power cable at the power cam and let-out of the bowstring and control cables at the power cam as the bow is drawn. In dual-cam bows, power cams are mounted on the ends of both limbs, with each including groove segments to control let-out of the bowstring cable at the opposing cam.

A general object of the present disclosure is to provide a compound archery bow that achieves enhanced power and arrow speed as compared with compound archery bows of the prior art and/or to reduce or eliminate timing issues between cams on dual cam bows.

The present disclosure embodies a number of aspects that can be implemented separately from or in combination with each other.

A compound archery bow, in accordance with one aspect of the present disclosure, includes a handle having projecting limbs, and first and second pulleys mounted on the limbs for rotation around respective axes. At least a first of the pulleys includes a flat base with a bowstring let-out groove on the base and a bowstring anchor adjacent to the bowstring let-out groove. A draw module is disposed on the base, a cable groove extends along the draw module, and first and second cable anchors are disposed on the base adjacent to respective ends of the cable groove. The cable groove on the draw module is continuous in a plane perpendicular to the axis of the first pulley. A bow cable arrangement includes a bowstring cable extending from the bowstring anchor on the first pulley around the bowstring let-out groove and then toward the second pulley. A first cable extends from the first anchor on the first pulley through a portion of the cable groove on the module and then toward the second pulley. A second cable extends from the second anchor toward the second pulley. Draw of the bowstring cable away from the bow handle lets out bowstring cable from the bowstring cable groove on the first pulley and rotates the first pulley around its axis, lets out the first cable from the groove on the module and takes up the second cable into the groove on the module including a portion of such groove previously occupied by the first cable.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
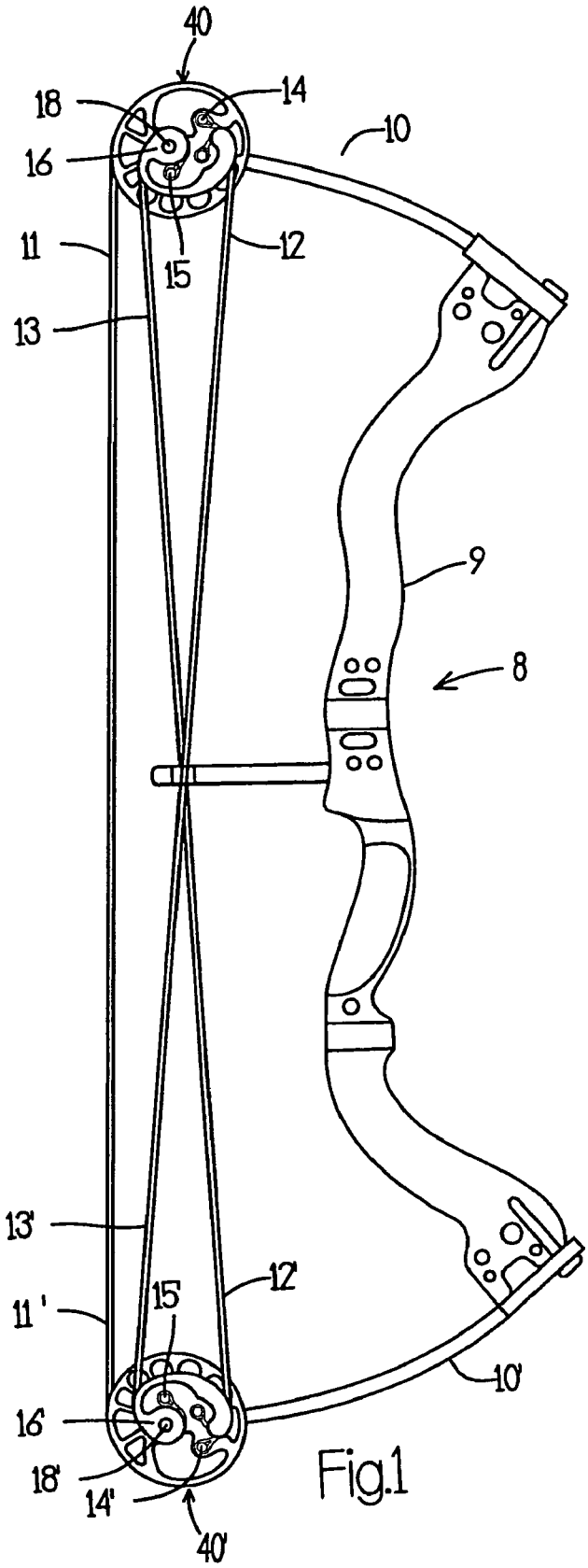
FIG. 1 is an elevational view of a compound archery bow in accordance with an exemplary first embodiment of the present disclosure.

FIGS. 1, 2, 2A and 6 illustrate a dual-cam compound archery bow 8 in accordance with one exemplary embodiment of the present disclosure as comprising a handle 9 of aluminum or other relatively rigid construction having spaced risers with bow-mounting surfaces at each end. A pair of flexible resilient limbs 10,10' of fiber-reinforced resin or other suitable resilient construction are mounted on the respective handle risers and project away from handle 9. An upper pulley 40 is mounted on limb 10 for rotation around an axle 18, and a lower pulley 40' is mounted on an end of limb 10' for rotation around an axle 18'. Bow 8 in FIGS. 1-2A and 6 is a dual-cam bow in which pulleys 40,40' are similar in functions and preferably are near mirror images of each other. (Upper pulley 40 can be slightly larger than lower pulley 40' to compensate for the arrow rest not being at the true center of the bow. Some pulleys also can be made non-identical in areas that are non-functional to create a desired difference in appearance.)

Pulley 40 includes a flat base 42 having a bowstring let-out groove 23 extending around at least a portion of the periphery of the base in a plane perpendicular to the axis of axle 18. A bowstring cable end 11 extends from a bowstring anchor 17 on base 42 around groove 23 and toward pulley 40' at the opposing end of the bow, at which bowstring cable end 1' extends through groove 23 of base 42' to an anchor 17'. A draw module 16 is disposed on base 42. Draw module 16 in this embodiment preferably is permanently mounted on base 42, such as by being formed in one piece with the base. Draw module 16 has a groove 22 that extends around the module and around the axis of rotation of pulley 40. Groove 22 is continuous in a plane perpendicular to the axis of axle 18. Pulley 40' is a mirror image or near-mirror image of pulley 40, and corresponding elements of pulley 40' are indicated with the same reference numeral and a prime symbol.

A first cable end 13 extends from an anchor 15 on base 42 around a portion of groove 22 on module 16 and then toward pulley 40', at which the opposing end 12' is secured to an anchor 14', preferably after passing around a portion of groove 22 on module 16'. A second cable end 12 extends from an anchor 14 on pulley 40, preferably through at least a portion of groove 22 on module 16, to pulley 40', at which the opposing cable end 13' extends through a portion of groove 22 on module 16' to an anchor 15'. Thus, as bowstring cable 11,11' is pulled away from handle 9 (to the left in FIGS. 1 and 2), the bowstring cable unwraps from bowstring let-out groove 23 on base 42 of pulley 40 and base 42' of pulley 40'. Pulleys 40,40' thereby are rotated in opposite directions by draw of bowstring cable 11,11', letting out portions of cable ends 13,13' and taking up portions of cable ends 12,12'. The portions of cable ends 12,12' taken up into module grooves 22 occupy at least some portion of the module grooves previously occupied by let-out cable ends 13,13'. That is, cable grooves 22 on modules 16,16' function both as let-out grooves for cable ends 13,13' and as take-up grooves for cable ends 12,12' Thus, with the bowstring fully drawn in FIG. 1A in this example, cable end 13 is substantially or entirely unwrapped from module 16 and cable end 12 is wrapped substantially entirely around the module.

The opposing pulleys thus are slaved together and eliminate any cam-to-cam timing issues. Cable ends 13,13' are let out at a significantly lower rate than take-up of cable ends 12,12', which results in maximum limb compression of the opposing bow limbs. This helps achieve a high level of stored bow energy, dynamic efficiency and kinetic energy, achieving improved arrow speed. Stops 19, 19' on pulleys 40, 40' abut the bow limbs to limit bow draw.

FIGS. 1A, 3-5 and 7-10B illustrate modified embodiments of the disclosure. In each embodiment, elements that correspond to elements previously discussed in connection with FIGS. 1-2A and 6 are identified by correspondingly identical reference numerals with a letter suffix.

Figure 3:
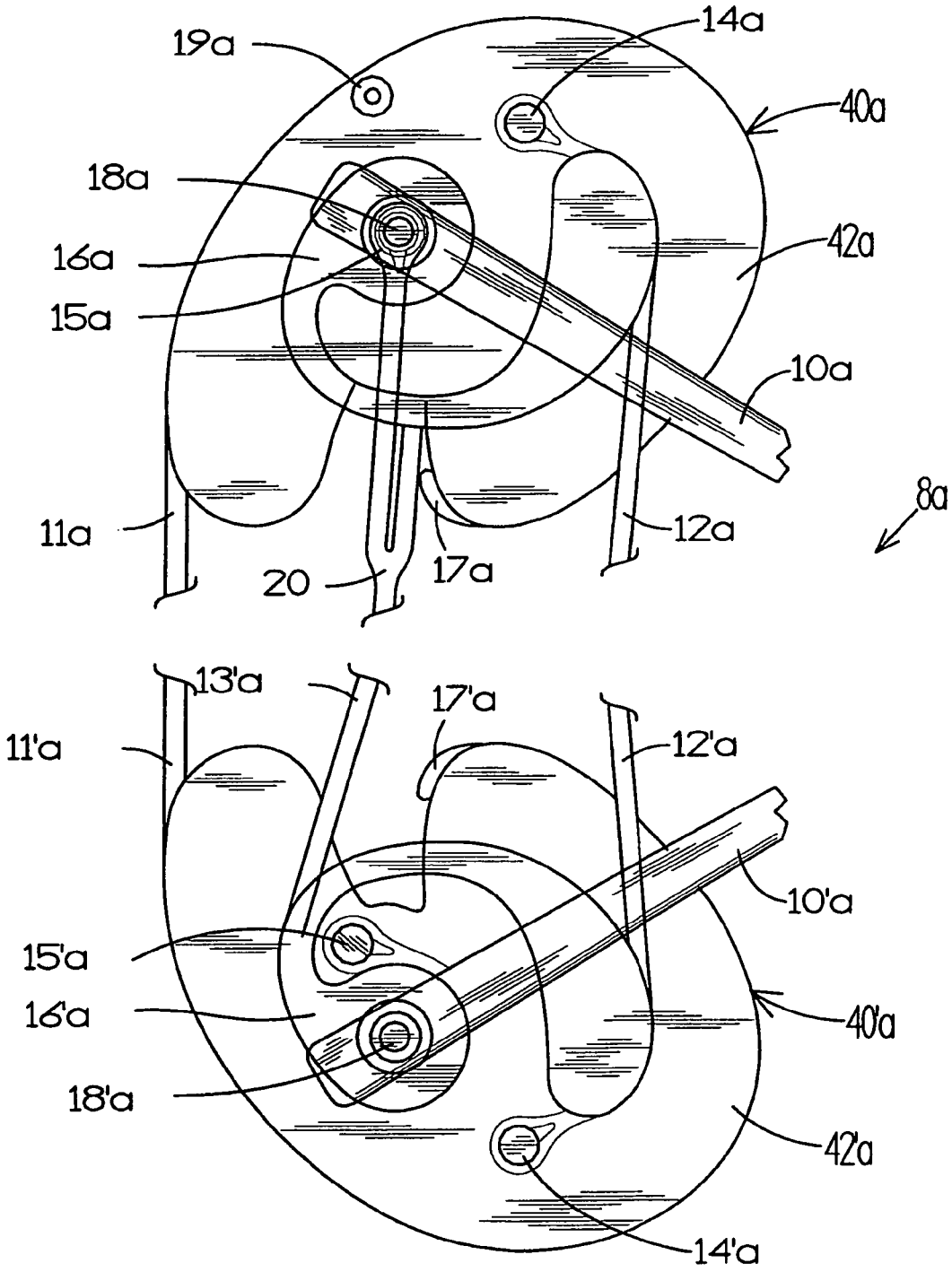
FIG. 3 is a fragmentary elevational view similar to those of FIG. 2 but illustrating a second embodiment of the disclosure.

In bow 8*a* of FIG. 3, the bow cable having lower end 12'*a* has its upper end 20 anchored at axle 18*a*. Thus, in this embodiment, the upper end 20 is not let out from the groove of module 16*a*. However, lower pulley 40'*a* operates as preciously described. Bowstring cable ends 11*a*, 11'*a* are secured to pulleys 40*a*, 40'*a* at anchors 17*a*, 17'*a*.

Figure 2A:
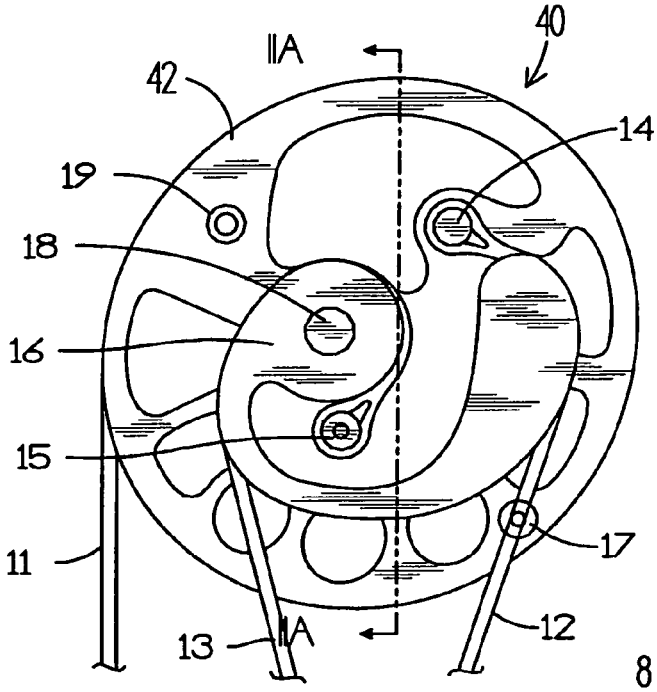
FIG. 2A is a sectional view taken substantially along the line 2A-2A of FIG. 2.
Figure 2A:
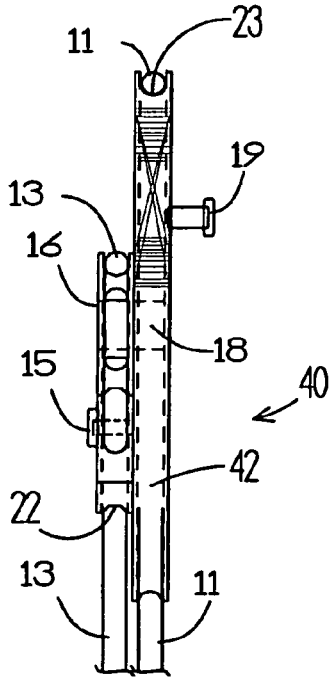
Figure 2:
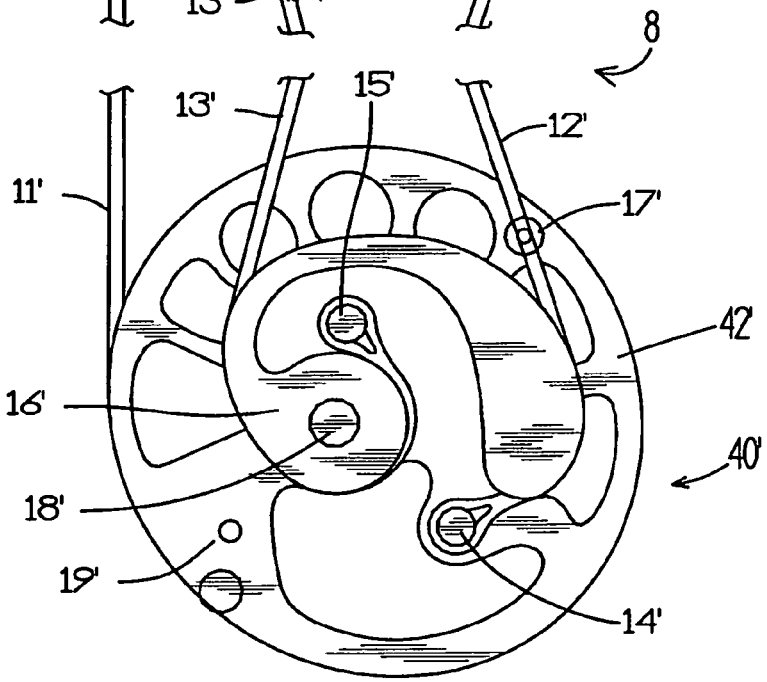
FIG. 2 is a fragmentary elevational view on an enlarged scale of the pulleys in the bow of FIG. 1.
Figure 4:
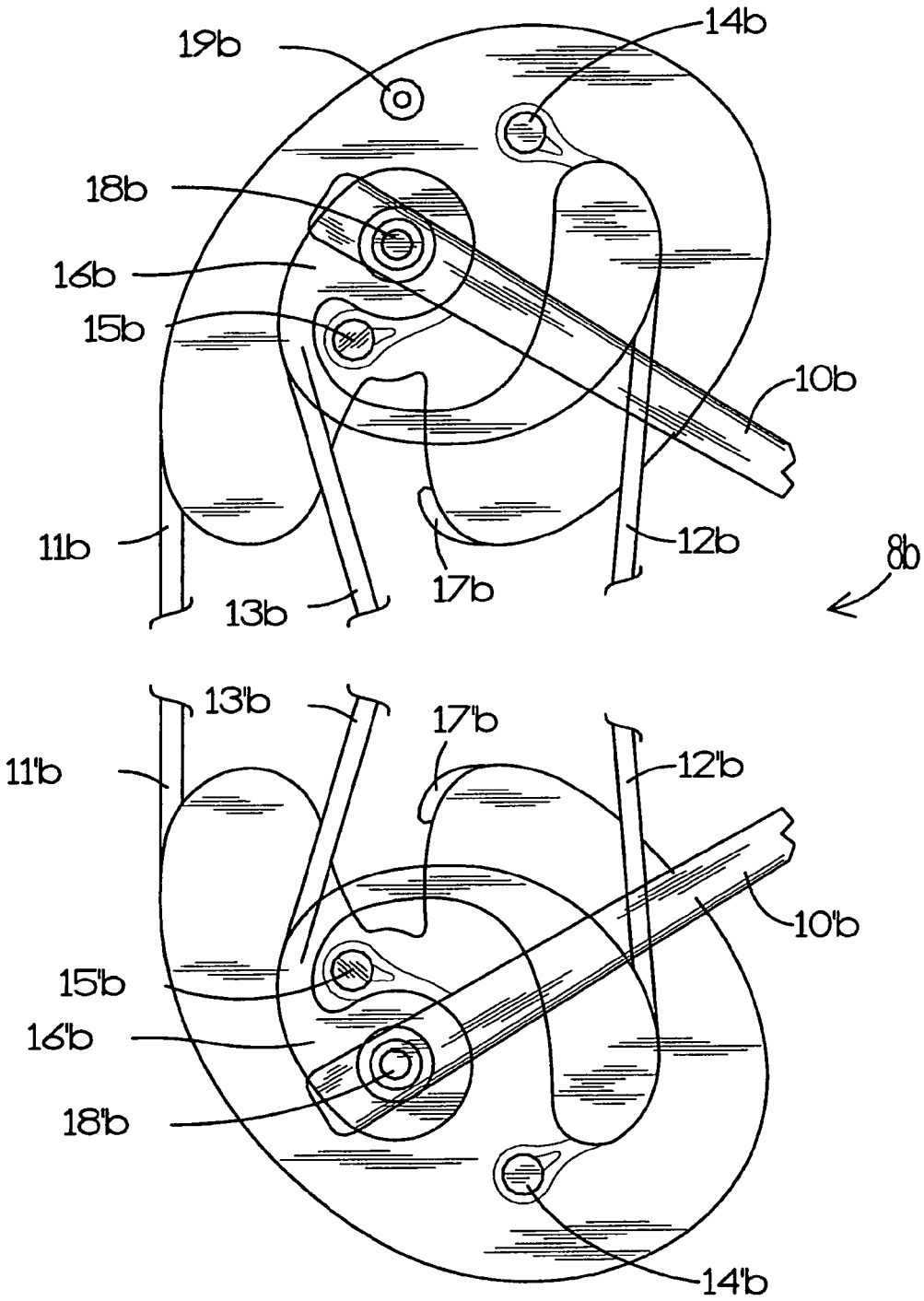
FIG. 4 is a fragmentary elevational view similar to those of FIGS. 2 and 3 but illustrating another embodiment of the disclosure.

Bow 8*b* of FIG. 4 is similar to bow 8 in FIG. 2 except for a different shape to the bowstring groove and different placement of bowstring anchors 17*b*, 17'*b*.

Figure 5:
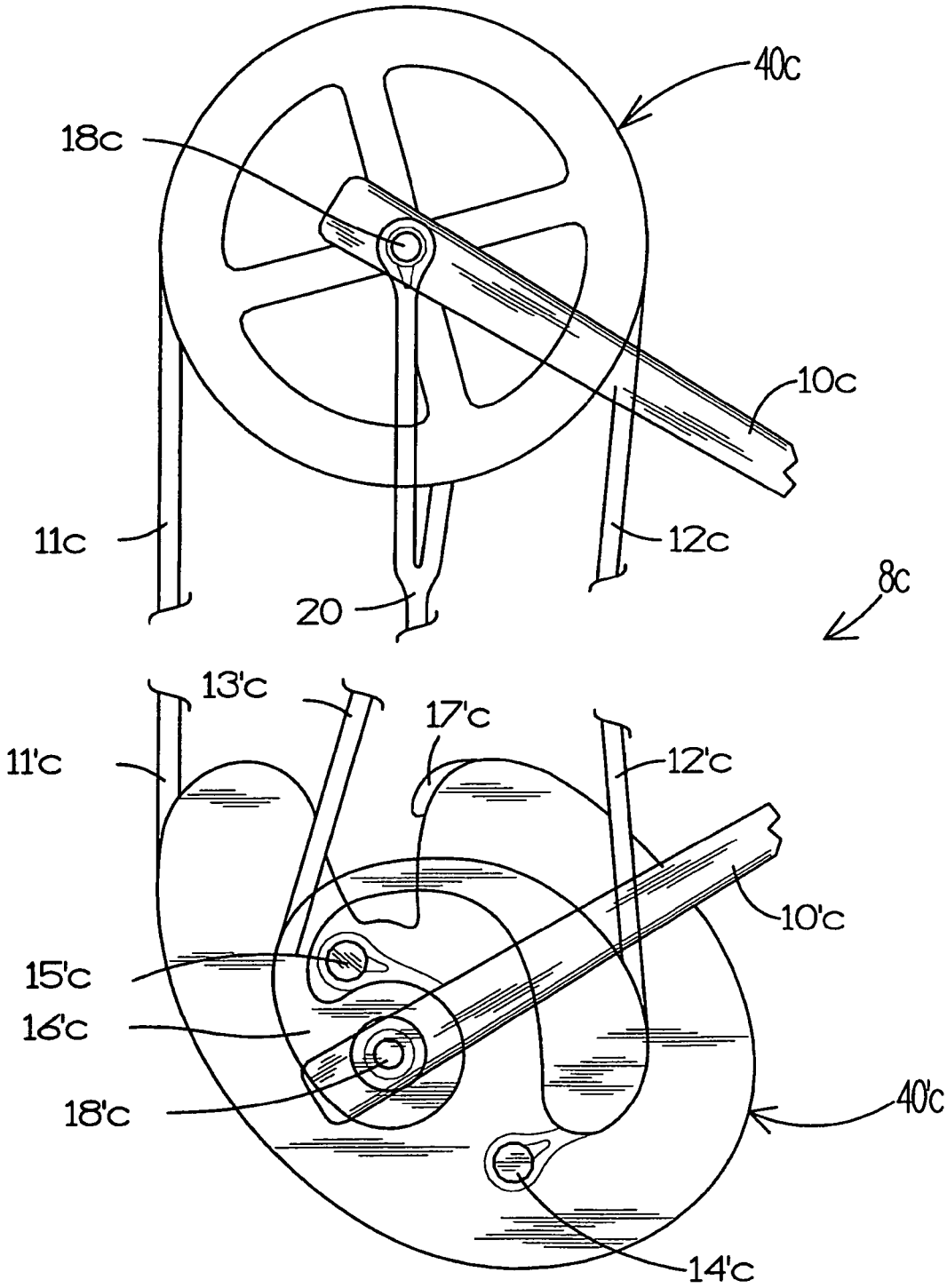
FIG. 5 is a fragmentary elevational view similar to those of FIGS. 2, 3 and 4 but illustrating a further embodiment of the disclosure.
Figure 6:
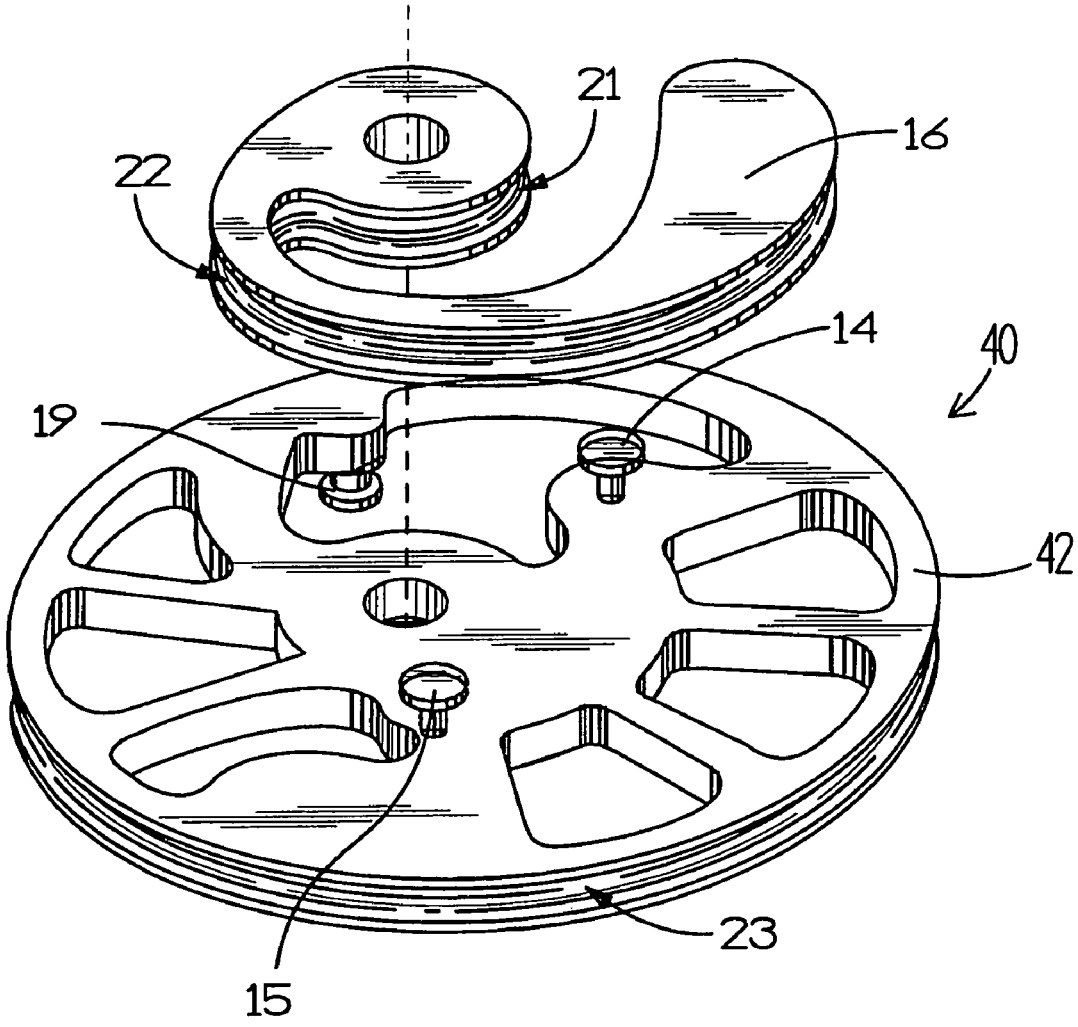
FIG. 6 is an exploded perspective view of the power cam in the embodiment of FIGS. 1-2A.

FIG. 5 illustrates an exemplary single cam bow 8*c* in accordance with the present disclosure, in which the upper pulley 40*c* is a wheel having a peripheral groove concentric with the axis of axle 18*c*. Lower pulley 40'*c* is the same as pulley 40'*a* in FIG. 3. Thus, in the embodiment of FIG. 5, the bowstring cable extends from end 11'*c* at pulley 40'*c* to end 11*c* at pulley 40*c*, around pulley 40*c* to cable end 12*c*, then to cable end 13'*c* around module 16'*c* to anchor 15'*c*. Cable end 12'*c* extends from anchor 14'*c*, preferably around a portion of the module groove, to cable end 20 anchored at axle 18*c*.

Figure 7:
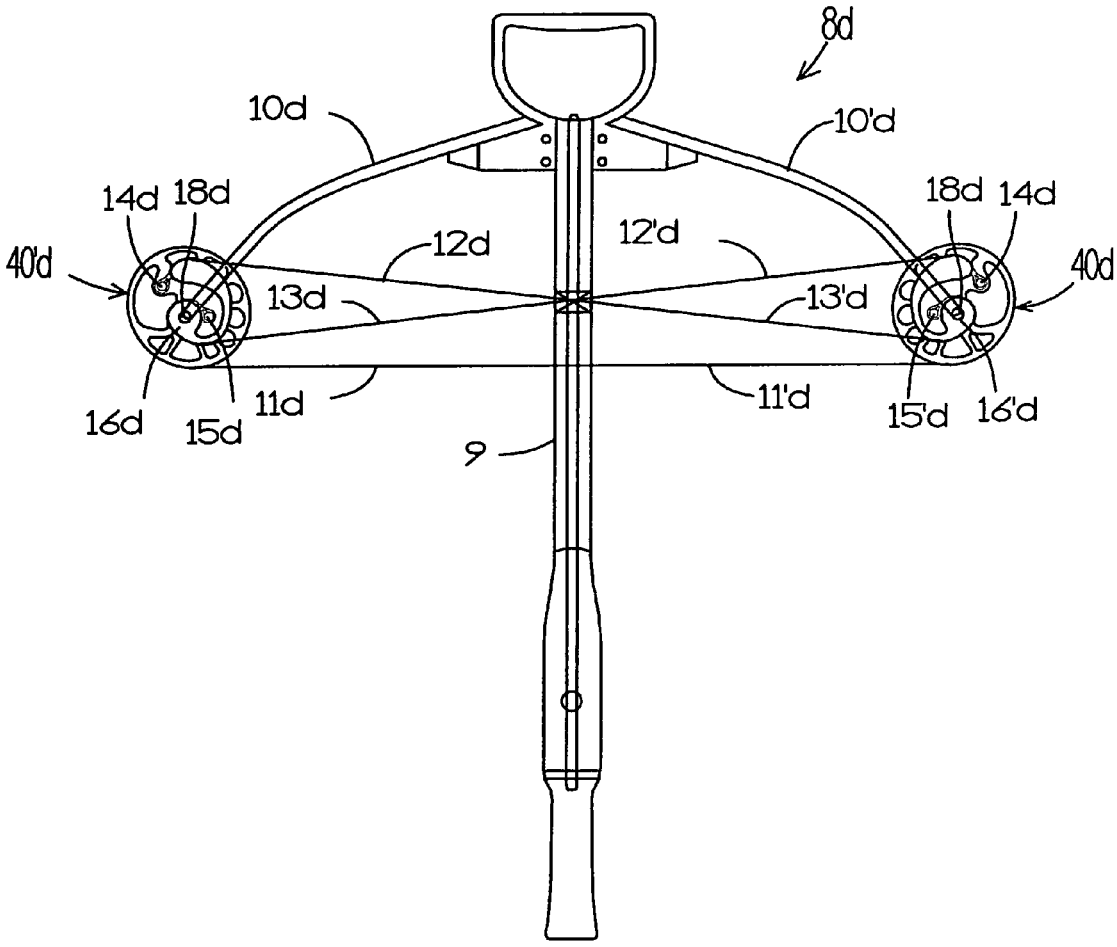
FIG. 7 is a top plan view of a crossbow that embodies the principles of the present disclosure.

FIG. 7 illustrates a crossbow 8*d* that employs pulleys 40*d*, 40'*d* similar to those discussed in detail above in connection with the embodiment of FIGS. 1-2A and 6.

Figure 8A:
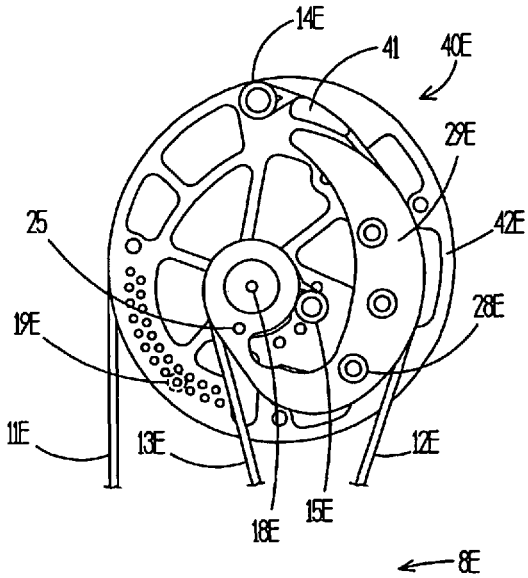
FIG. 8A is an elevational view of the back side of the top pulley in FIG. 8.
Figure 8A:
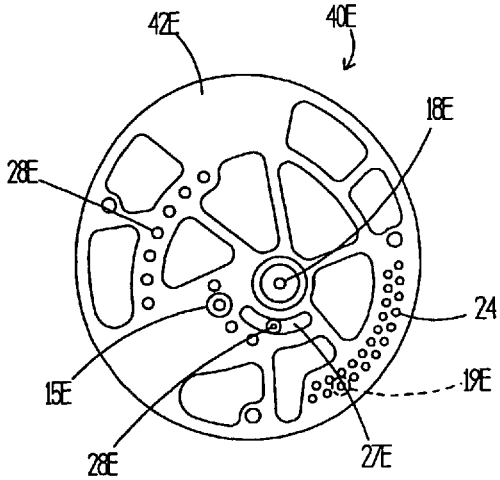
Figure 8:
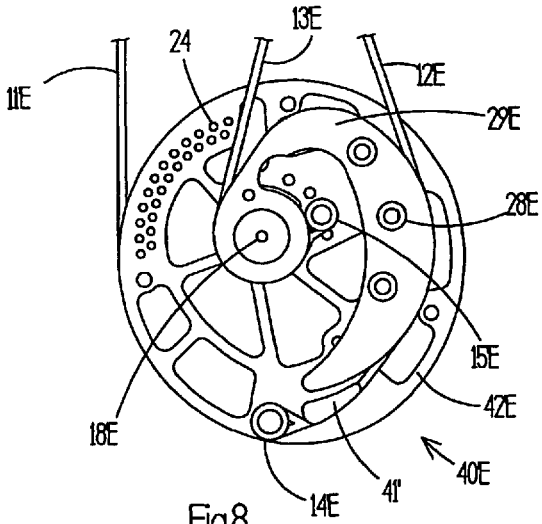
FIG. 8 is a fragmentary elevational view similar to those of FIGS. 2, 3, 4 and 5 but illustrating a further embodiment of the present disclosure.
Figure 8B:
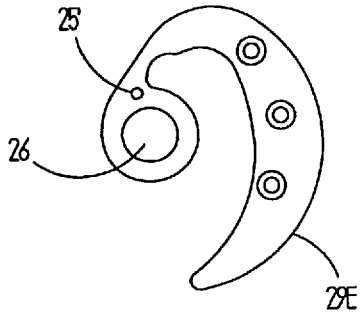
FIG. 8B is an elevational view of a replaceable draw module in the bow of FIG. 8.

FIGS. 8-8B illustrate a dual-cam bow 8E, in which the draw modules 29E,29'E of pulleys 40E,40'E have adjustably positionable draw length modules 29E,29'E rather than fixed-position draw length modules as in the prior embodiments. Bases 42E, 42'E of pulleys 40E, 40'E have threaded openings that receive screws 28E, 28'E for anchoring modules 29E, 29'E. Each module 29E, 29'E has an opening 26 that can be either concentric with or eccentric to the periphery of the module, and that encircles the associated axle 18E or 18'E so that the module can be adjustably pivoted around the axle to adjust bow draw length. A piece 41, 41' is affixed to each pulley base 42E, 42'E to guide cable ends 12E, 12'E from modules 29E, 29'E to anchors 14E, 14'E. Threaded openings 24 on bases 42E, 42'E provide for adjustable positioning of draw stops 19E.

Figure 9:
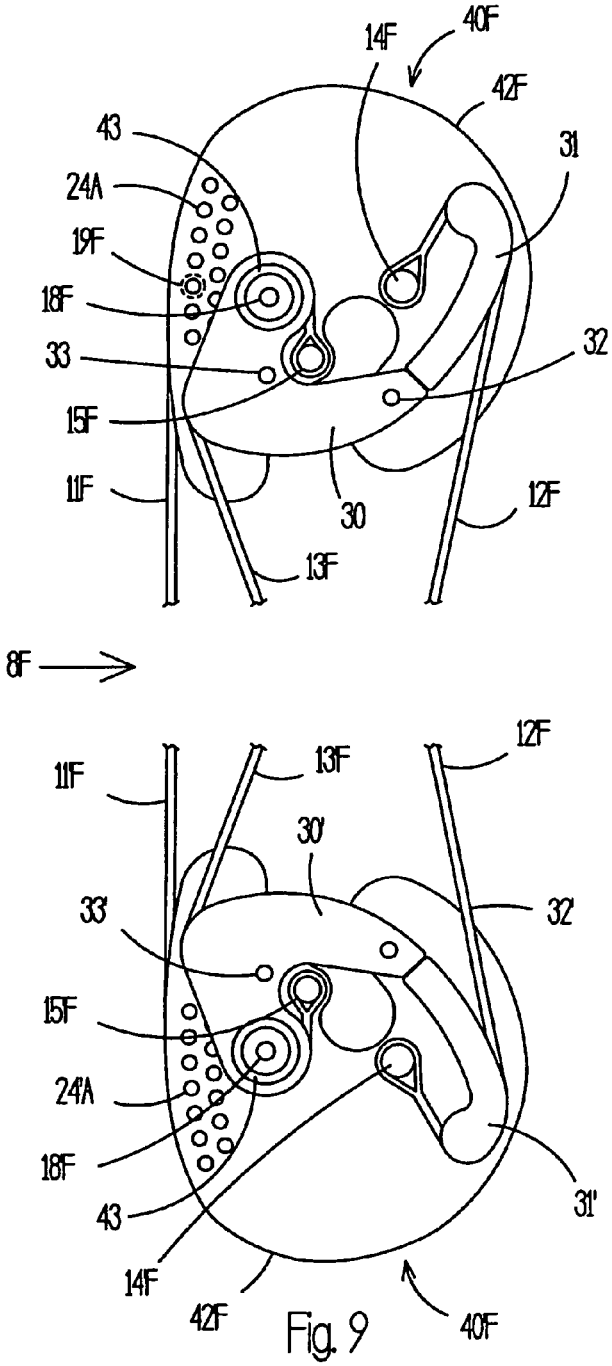
FIG. 9 is a fragmentary elevational view of a further embodiment of the present disclosure.
Figure 9A:
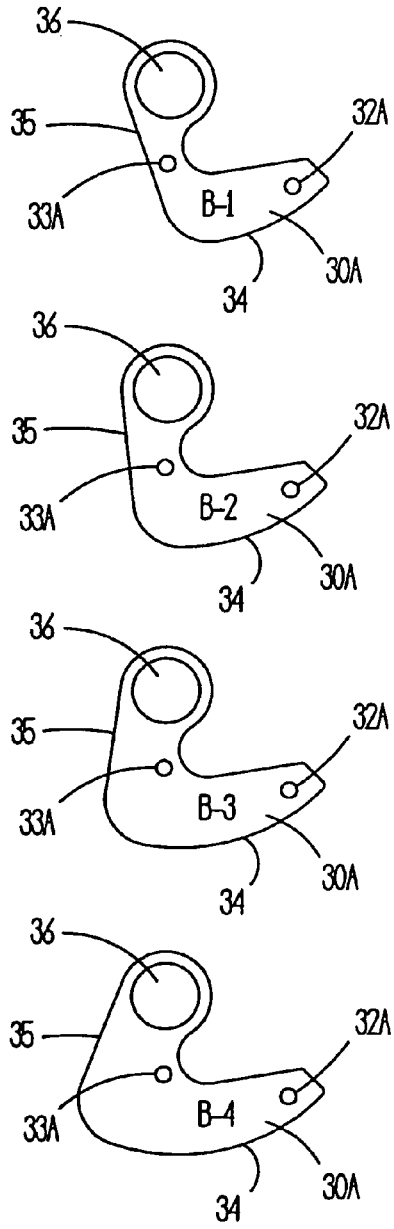
FIG. 9A is elevational views of replaceable draw length modules for the embodiment of FIG. 9.

FIG. 9 illustrates a dual-cam bow 8F. Pulleys 40F, 40'F have replaceable non-adjustable draw length modules 30, 30'. Each module has an opening 36 that embraces the associated axle 18F, 18'F or axle boss 43, 43'. Modules 30, 30' are secured in position by screws 32, 33 and 32', 33' threaded into openings 32A, 33A (FIG. 9A). Adjacent to module 30, 30' are sections 31, 31 respectively affixed to bases 42F, 42'F of pulleys 40F, 40'F. Sections 31, 31' have cable grooves that form respective extensions of the module cable grooves 34. Thus, in this embodiment, the let-out/take-up groove formed in each module 30, 31' is continued onto associated fixed section 31, 31'. In this embodiment, cable ends 12F,12'F initially are taken up into the grooves on sections 31,31' and then into the grooves on replaceable modules 30,30'. FIG. 9A illustrates a number of replaceable modules 30,30' for different bow draw lengths.

Figure 1A:
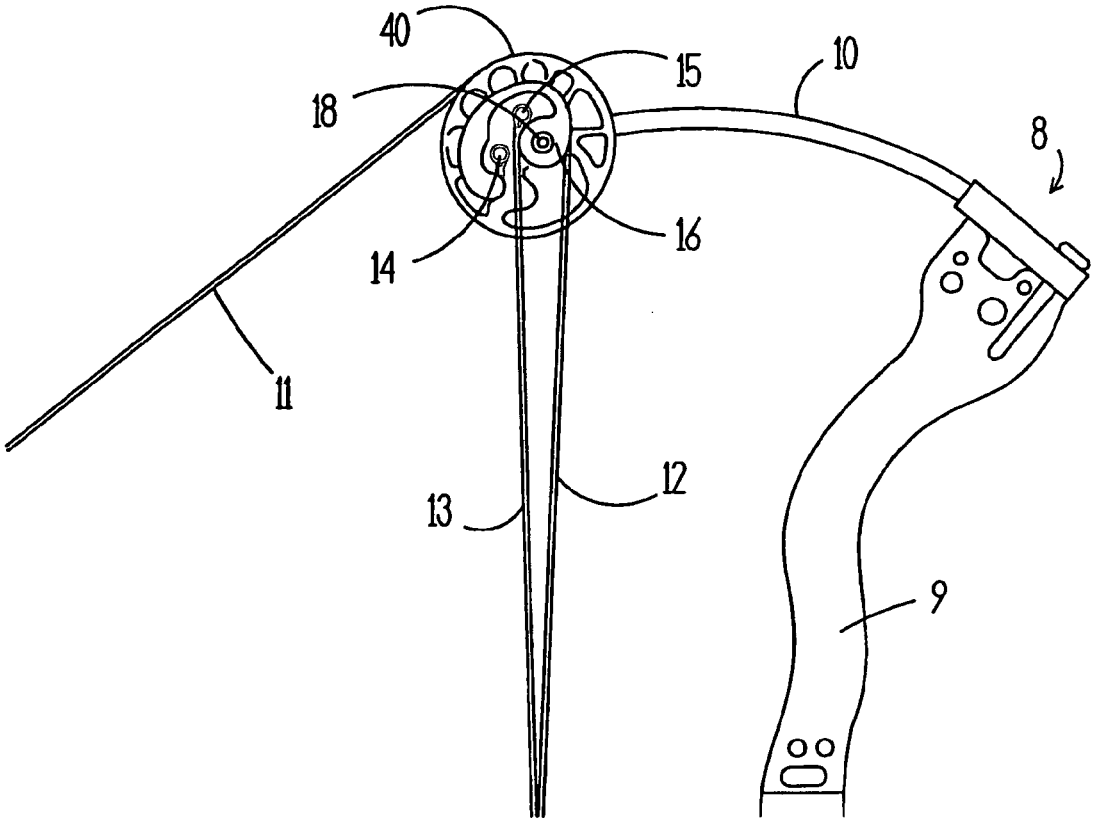
FIG. 1A is a fragmentary view of the upper portion of the bow in FIG. 1 with the bowstring fully drawn.
Figure 1B:
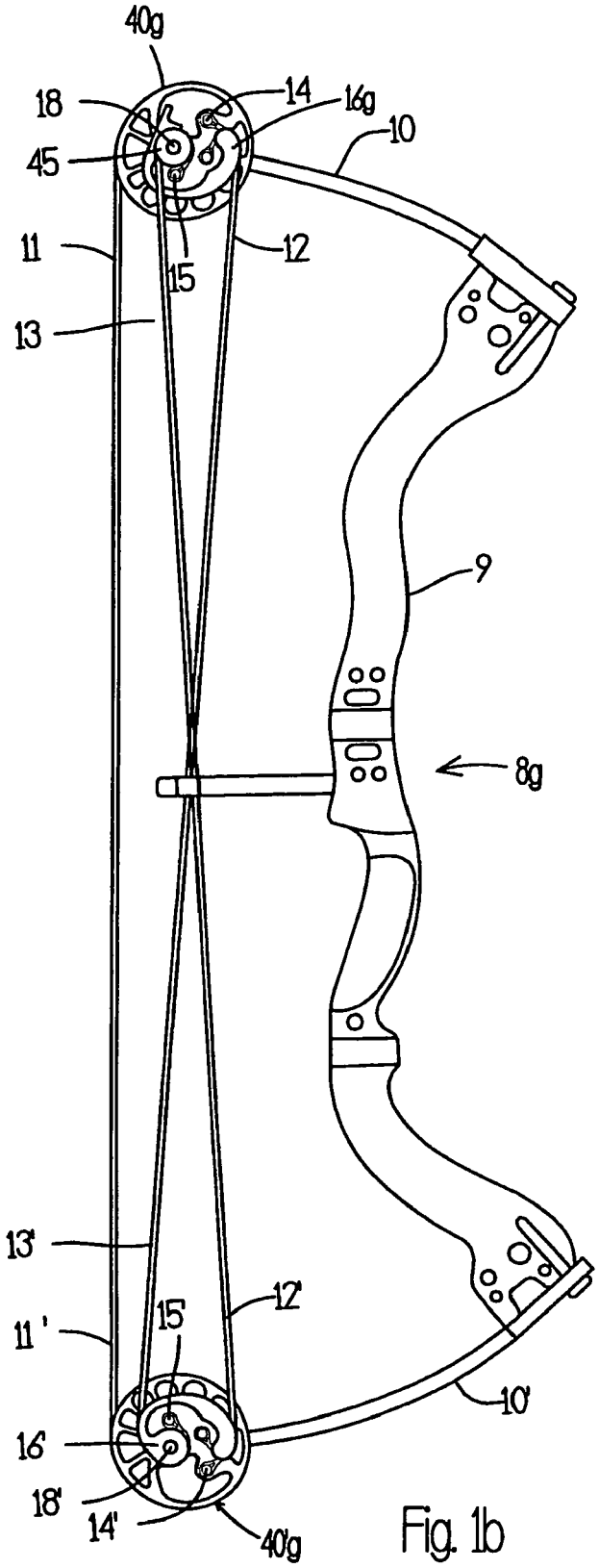
FIG. 1B is an elevational view of a modification to the embodiment of FIG. 1.

FIG. 1B illustrates a bow 8*g* in which lower pulley 40'*g* is the same as pulley 40' in FIGS. 1-2, but upper pulley 40*g* is modified. Pulley 40*g* in this embodiment preferably includes a module 16*g* with a groove for taking up cable end 12, and a pulley section 45 with a groove for letting out cable 13. Pulley 40*g* and pulley section 45 preferably are as disclosed in U.S. Pat. No. 6,996,970.

Figure 10A:
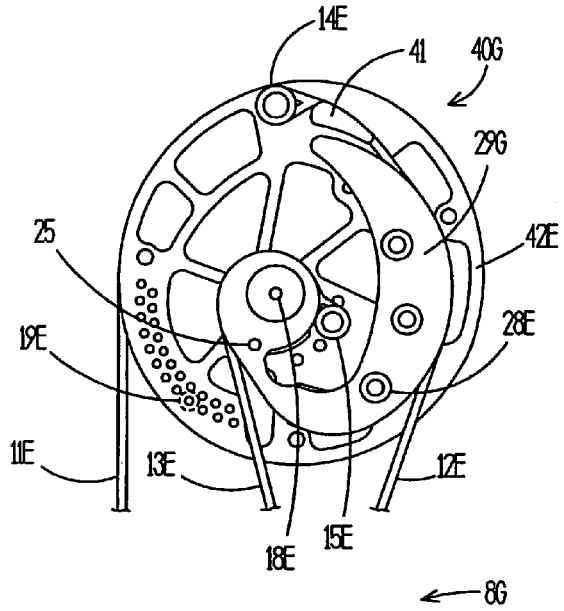
FIG. 10A is an elevational view of the base in the upper pulley of FIG. 10.
Figure 10A:
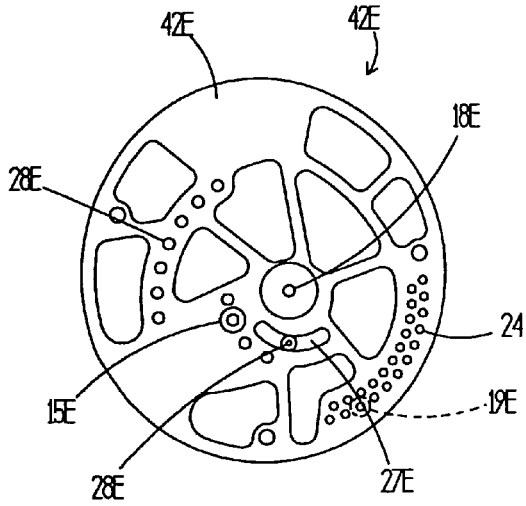
Figure 10:
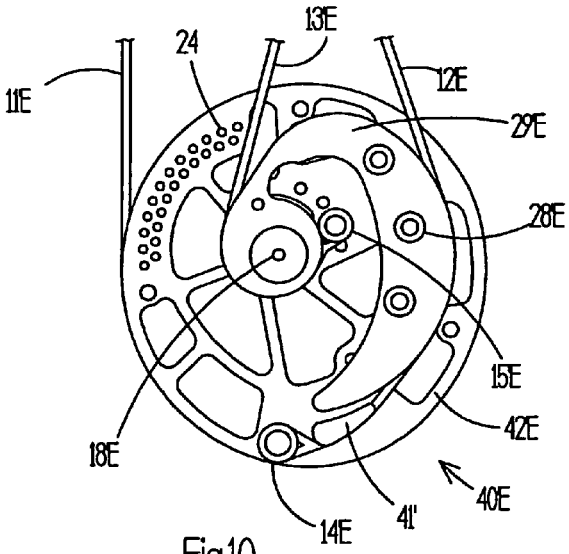
FIG. 10 is a fragmentary elevational view of a bow in accordance with a further embodiment of the disclosure.
Figure 10B:
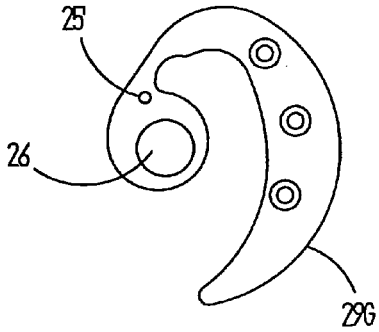
FIG. 10B is an elevational view of the draw length module in the upper pulley of FIG. 10.

FIGS. 10-10B illustrate a bow 8G that is very similar to the bow 8E of FIGS. 8-8B except that the opening 26G in the draw length module 29G is eccentric to the periphery of the module rather than concentric as in FIGS. 8-8B.

Adjustment of the bow draw lengths in the embodiments of FIGS. 1-7 and 9 requires replacement of the draw length modules, which in turn requires disassembly of each pulley from the bow because the modules are mounted on the pulley axles. In the embodiments of FIGS. 8 and 10, the draw length modules are adjustably pivotal around the axles so that draw lengths can be adjusted within a limited range without disassembly of the pulleys.

There thus has been disclosed a compound archery bow that fully satisfies all of the objects and aims previously set forth. The bow has been disclosed in conjunction with a number of exemplary embodiments. Modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A compound archery bow that includes:

a bow handle having projecting limbs, a first pulley mounted on a first of said limbs for rotation around a first axis, a second pulley mounted on a second of said limbs for rotation around a second axis, at least said first pulley including a flat base, a bowstring let-out groove on said base, a bowstring anchor adjacent to said bowstring let-out groove, a draw module on said base, a cable groove on said draw module that is continuous in a plane perpendicular to said first axis, a first cable anchor adjacent to one end of said cable groove and a second cable anchor adjacent to a second end of said cable groove, and bow cable means including a bowstring cable extending from said bowstring anchor through said bowstring let-out groove on said first pulley and then toward said second pulley, a first cable extending from said first anchor through a portion of said cable groove on said module and then toward said second pulley, and a second cable extending from said second anchor toward said second pulley, wherein draw of said bowstring cable away from said handle lets out bowstring cable from said bowstring let-out groove and rotates said first pulley around said first axis, lets out said first cable from said groove on said module and takes up said second cable into at least a portion of said groove on said module previously occupied by said first cable, and wherein said bow is a dual-cam bow with said first and second pulleys being similar in function and near mirror images of each other.

2. The bow set forth in claim 1 wherein said second cable extends from said second anchor through a portion of said cable groove on said module and then toward said second pulley.

3. The bow set forth in claim 1 wherein said draw module is removably mounted on said base.

4. The bow set forth in claim 3 wherein said first pulley has a fixed portion mounted on said base in alignment with said module, said groove on said module extending onto said fixed portion and said second anchor being disposed adjacent to said fixed portion.

5. The bow set forth in claim 1 wherein said draw module is adjustably mounted on said base.

6. The bow set forth in claim 1 wherein said bow is a crossbow.

7. A compound archery bow that includes:

a bow handle having projecting limbs, a first pulley mounted on a first of said limbs for rotation around a first axis, said first pulley including a bowstring let-out groove, a bowstring anchor adjacent to said bowstring let-out groove, a cable groove in a plane perpendicular to said first axis, a first cable anchor adjacent to one end of said cable groove and a second cable anchor adjacent to a second end of said cable groove, a second pulley mounted on a second of said limbs for rotation around a second axis, said second pulley including a bowstring let-out groove, a bowstring anchor adjacent to said bowstring let-out groove, a cable groove in a plane perpendicular to said second axis, a first cable anchor adjacent to one end of said cable groove and a second cable anchor adjacent to a second end of said cable groove, and bow cable means including a bowstring cable extending from said bowstring anchor through said bowstring let-out groove on said first pulley and then through said bowstring let-out groove to said bowstring anchor on said second pulley, a first cable extending from said first anchor through a portion of said cable groove on said first pulley, then to said second pulley and then through a portion of said cable groove on said second pulley to said second anchor on said second pulley, and a second cable extending from said first anchor on said second pulley through a portion of said cable groove on said second pulley, then to said first pulley and then through a portion of said cable groove on said first pulley to said second anchor on said first pulley, wherein draw of said bowstring cable away from said handle lets out bowstring cable from said bowstring let-out grooves and rotates said first and second pulleys around said first and second axes, lets out said first cable from said cable groove on said first pulley and takes up said first cable into a portion of said cable groove on said second pulley, and lets out said second cable from said cable groove on said second pulley and takes up said second cable into a portion of said cable groove on said first pulley.

8. The bow set forth in claim 7 wherein said bow is a crossbow.

9. The bow set forth in claim 8 wherein said draw module is angularly adjustable around said first axis of said first pulley.

10. The bow set forth in claim 9 wherein said bow has an axle on which said first pulley is mounted for rotation around said first axis, and wherein said draw module has an opening that encircles said axle.

11. The bow set forth in claim 7 wherein said bow is a dual-cam bow with said first and second pulleys being similar in function and near mirror images of each other.

12. The bow set forth in claim 7 wherein said bow is a single-cam bow, said second pulley comprising a wheel with a continuous peripheral groove.

13. A compound archery bow that includes:

a bow handle having projecting limbs, a first pulley mounted on a first of said limbs for rotation around a first axis, a second pulley mounted on a second of said limbs for rotation around a second axis, at least said first pulley including a flat base, a bowstring let-out groove on said base, a bowstring anchor adjacent to said bowstring let-out groove, a draw module on said base, a cable groove on said draw module that is continuous in a plane perpendicular to said first axis, a first cable anchor adjacent to one end of said cable groove and a second cable anchor adjacent to a second end of said cable groove, and bow cable means including a bowstring cable extending from said bowstring anchor through said bowstring let-out groove on said first pulley and then toward said second pulley, a first cable extending from said first anchor through a portion of said cable groove on said module and then toward said second pulley, and a second cable extending from said second anchor toward said second pulley, wherein draw of said bowstring cable away from said handle lets out bowstring cable from said bowstring let-out groove and rotates said first pulley around said first axis, lets out said first cable from said groove on said module and takes up said second cable into at least a portion of said groove on said module previously occupied by said first cable, and wherein said draw module is removably mounted on said base, and said first pulley has a fixed portion mounted on said base in alignment with said module, said groove on said module extending onto said fixed portion and said second anchor being disposed adjacent to said fixed portion.

14. A compound archery bow that includes:

a bow handle having projecting limbs, a first pulley mounted on a first of said limbs for rotation around a first axis, a second pulley mounted on a second of said limbs for rotation around a second axis, at least said first pulley including a flat base, a bowstring let-out groove on said base, a bowstring anchor adjacent to said bowstring let-out groove, a draw module adjustably mounted on said base, a cable groove on said draw module that is continuous in a plane perpendicular to said first axis, a first cable anchor adjacent to one end of said cable groove and a second cable anchor adjacent to a second end of said cable groove, and bow cable means including a bowstring cable extending from said bowstring anchor through said bowstring let-out groove on said first pulley and then toward said second pulley, a first cable extending from said first anchor through a portion of said cable groove on said module and then toward said second pulley, and a second cable extending from said second anchor toward said second pulley, wherein draw of said bowstring cable away from said handle lets out bowstring cable from said bowstring let-out groove and rotates said first pulley around said first axis, lets out said first cable from said groove on said module and takes up said second cable into at least a portion of said groove on said module previously occupied by said first cable.

* * * * *